United States Patent [19]

Howell

[11] Patent Number: 4,669,410

[45] Date of Patent: Jun. 2, 1987

[54] PORTHOLE CONSTRUCTION

[75] Inventor: George Howell, Windsor, Canada

[73] Assignee: Detroit Marine Engineering, Inc., Detroit, Mich.

[21] Appl. No.: 815,526

[22] Filed: Jan. 2, 1986

[51] Int. Cl.[4] ..... B63B 19/00

[52] U.S. Cl. ..... 114/173; 52/204; 244/129.3

[58] Field of Search ..... 114/173, 177, 178; 244/129.3; 49/171; 403/381; 296/146; 52/204, 212, 217

[56] References Cited

U.S. PATENT DOCUMENTS 3,191,240 6/1965 Slaman et al. ..... 52/204
4,021,967 5/1977 Mulder et al. ..... 49/171

FOREIGN PATENT DOCUMENTS 498077 1/1939 United Kingdom ..... 244/129.3

*Primary Examiner*—Joseph F. Peters, Jr.
*Assistant Examiner*—Edwin L. Swinehart
*Attorney, Agent, or Firm*—Barnes, Kisselle, Raisch, Choate, Whittemore & Hulbert

[57] ABSTRACT

A porthole construction for placement in an opening of a hull of a ship comprising a first plastic member made of transparent material and a second member made of plastic material. The first member includes an axial wall frictionally engaging the porthole opening, a transverse wall defining the window, and a radial wall extending radially outwardly from the axial wall and engaging the outside of the hull. Fasteners extend through the radial wall to hold the first member in position on the hull. The second member includes an axial wall frictionally engaging the inner surface of the axial wall of the first member, a radial wall overlying the radial wall of the first member and a second axial wall extending from the radial wall and engaging the hull about the radial wall of the first member. Interengaging members are provided between the radial walls of the first and second member to further hold the second member on the first member. In a modified form, a third member identical to the second member is provided on the opposite side of the hull frictionally engaging the inner surface of the axial wall of the first member.

12 Claims, 11 Drawing Figures

PORTHOLE CONSTRUCTION

This invention relates to porthole construction.

BACKGROUND AND SUMMARY OF THE INVENTION

In porthole construction for ships and the like, the structure for providing a window in the opening of the hull is often complex, costly and difficult to assemble.

Among the objectives of the present invention are to provide a porthole construction which is simple, low in cost, has long life and an aesthetic appearance.

In accordance with the invention, the porthole construction for placement in an opening of a hull of a ship comprises a first plastic member made of transparent material and a second member made of plastic material. The first member includes an axial wall frictionally engaging the porthole opening and a transverse wall defining the window, and a radial wall extending radially outwardly from the other end of the axial wall and engaging the outside of the hull. Fasteners extend through the radial wall to hold the first member in position on the hull. The second member includes an axial wall frictionally engaging the inner surface of the axial wall of the first member, a radial wall overlying the radial wall of the first member and a second axial wall extending from the radial wall and engaging the hull about the radial wall of the first member. Interengaging members are provided between the radial walls of the first and second member to further hold the second member on the first member. In a modified form, a third member identical to the second member is provided on the opposite side of the hull frictionally engaging the inner surface of the axial wall of the first member.

DESCRIPTION

Figure 1:
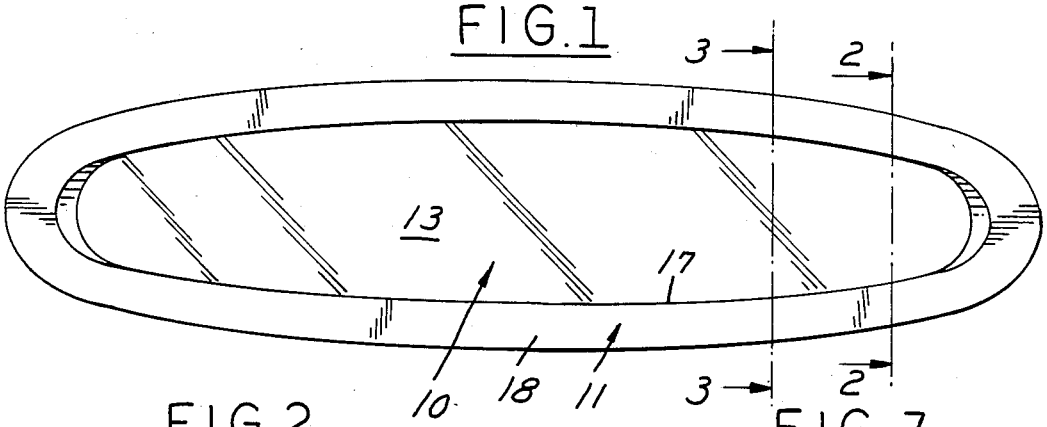
FIG. 1 is an elevational view of a porthole construction embodying the invention.
Figure 2:
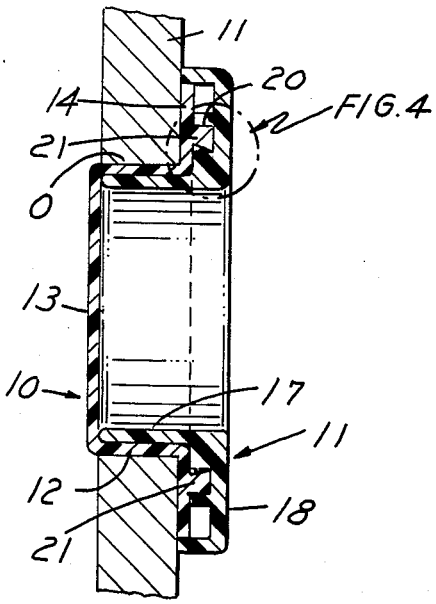
FIG. 2 is a fragmentary sectional view on an enlarged scale taken along the line 2—2 in FIG. 1.
Figure 3:
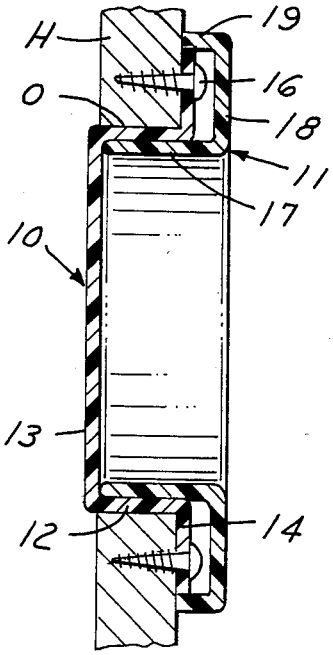
FIG. 3 is a sectional view on an enlarged scale taken along the line 3—3 in FIG. 1.
Figure 4:
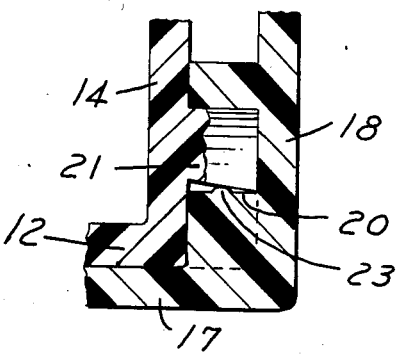
FIG. 4 is an enlarged portion of FIG. 2.

Referring to the drawings, the porthole construction is adapted to be placed in an opening O of a hull H, the opening O herein being shown as oval in configuration. In accordance with the invention, the porthole construction comprises a first plastic member 10 made of transparent plastic material such as polycarbonate and a second plastic member or bezel 11 made of opaque plastic material such as ABS.

The first plastic member 10 includes an annular axial wall 12, the outer surface of which frictionally engages the opening O in the hull, a transverse wall 13 extending from one end of the axial wall 12 and defining a window, a radial wall 14 extending from the other end of the axial wall 12 and engaging the outer surface of the hull. A plurality of openings 15 are provided in the radial wall 14 and screws 16 are used to fasten the first member 10 in position on the hull. The second member 11 is adapted to be positioned to provide a seal and an aesthetic appearance and comprises an annular axial wall 17 that frictionally engages the inner surface of the axial wall 12 of the first member, a radial wall 18, and a second axial wall 19 that extends from the periphery of the radial wall 18 toward the hull. The length of the axial wall 17 is greater than the length of the axial wall 12 such that the radial wall 18 is spaced from and overlies the radial wall 14.

Figure 5:
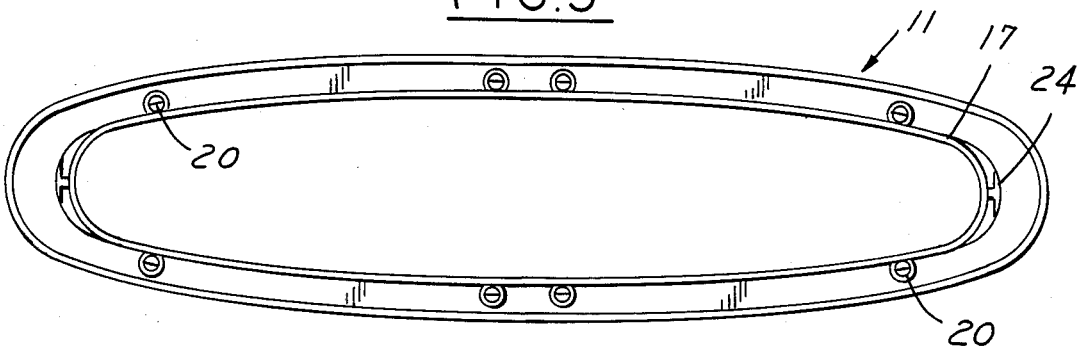
FIG. 5 is a plan view of one of the members.
Figure 6:
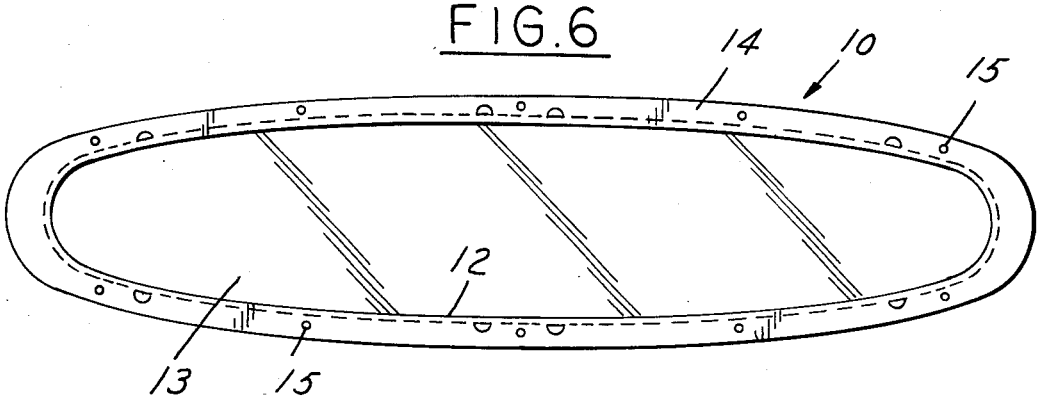
FIG. 6 is a plan view of the other of the members.
Figure 7:
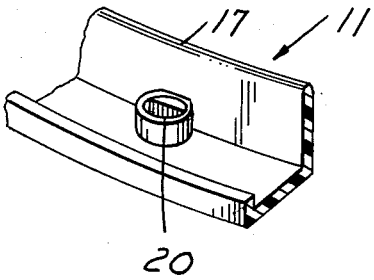
FIG. 7 is a fragmentary perspective view of a portion of the member shown in FIG. 5.
Figure 8:
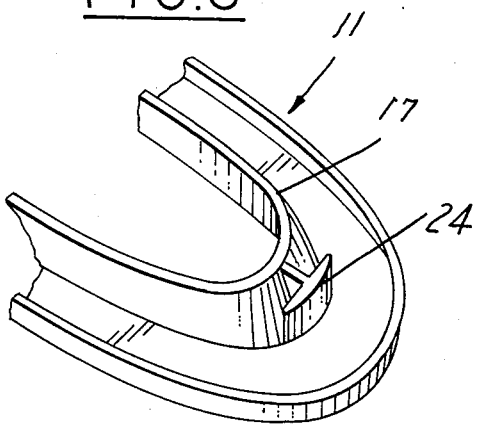
FIG. 8 is a fragmentary perspective view of another portion of the member shown in FIG. 5.

Interengaging means are provided between the radial walls 14, 18 to hold the first member in position and preferably comprise openings 20 in raised projections on wall 18 into which axially extending projections 21 extend and are frictionally engaged. More specifically, as shown in FIGS. 5 and 8, the openings 20 are D-shaped and the projections 21 have a similar configuration with a flat axial surface 22 that diverges outwardly and snaps over a locking bead 23.

In order to provide sufficient rigidity to the member 11, T-shaped reinforcing ribs 24 are provided at each end of the oval annular wall 17.

It can thus be seen that there has been provided a low cost and adequately sealed porthole construction which is easily assembled and provides an aesthetic appearance.

Figure 9:
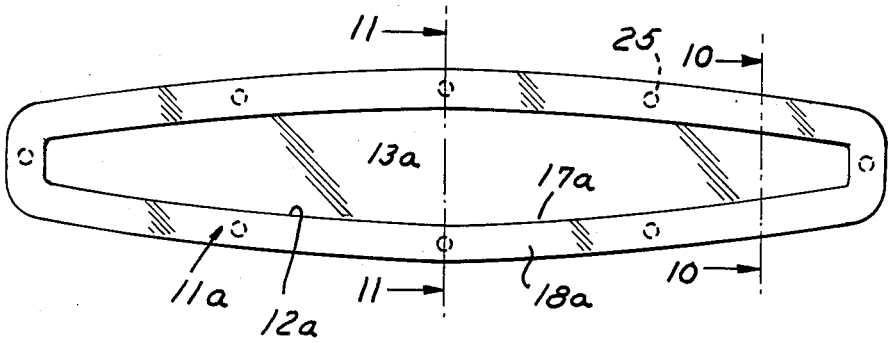
FIG. 9 is an elevational view of a modified form.
Figure 10:
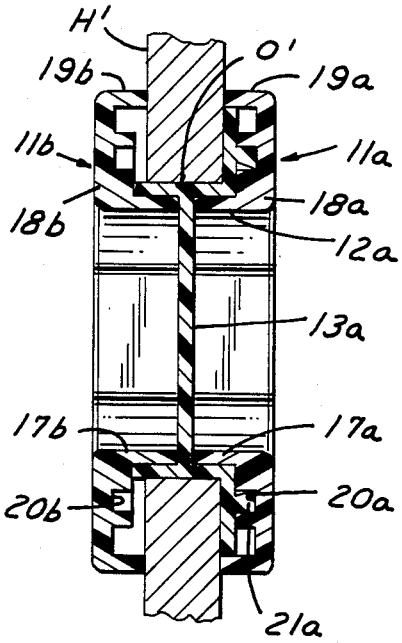
FIG. 10 is a fragmentary sectional view taken along the line 10—10 in FIG. 9.
Figure 11:
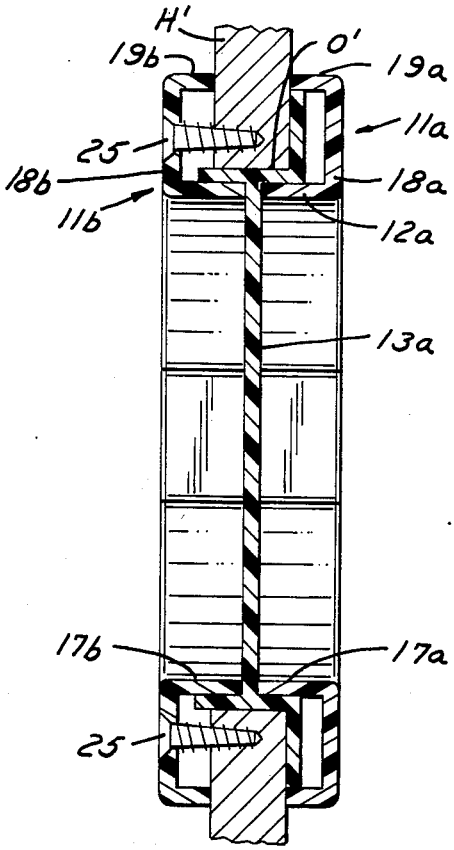
FIG. 11 is a fragmentary sectional view taken along the line 11—11 in FIG. 9.

In the modified form shown in FIGS. 9–11, the overall configuration of the opening O′ and the associated porthole construction including the members has a corresponding different configuration. The first member **10*a* has transverse wall 13*a* extending from axial wall 12*a* intermediate the ends of wall 12*a*. A third member 11*b* of identical construction as second member 11*a* is positioned on the opposite or inside of the hull H′ with the axial wall 17*b* frictionally engaging the axial wall 12*a* of the first member 10*a***.

The axial walls **17*a*, 17*b* extend toward one another and engage the transverse window wall 13*a*. Third member 11*b* is held in position by screws 25 extending through radial wall 18*b*** into the hull H′.

In this form the raised projections on radial wall **18*b* in which openings 20*b* are formed on the third member 11*b* perform the function of providing rigidity to wall 18*b*. However, there are no associated projections comparable to projections 21*a***.

I claim:

1. A portable construction for placement in an opening of a hull of a ship comprising a first plastic member made of transparent material and a second member made of plastic material, said first member including an axial wall adapted to engage the portable opening and adapted to extend axially with respect to the porthole opening, a transverse wall extending transversely from the axial wall and defining a window, and a radial wall extending radially outwardly from the axial wall and adapted to engage the outside of the hull, fastener means extending through the radial wall to hold the first member in position on the hull, said axial wall of said first member having an inner surface and an outer surface, said second member including a first axial wall adapted to extend axially with respect to the porthole opening and engaging the inner surface of the axial wall of the first member, a radial wall extending radially outwardly from said axial wall of said second member overlying the radial wall of the first member, and a second axial wall extending axially from the radial wall of said second member toward the the hull about the radial wall of the first member when the second member is in position on a hull, and interengaging means between the radial walls of the first and second member to further hold the second member on the first member.

2. The porthole construction set forth in claim 1 wherein said interengaging means comprises interfitting axial projections and openings.

3. The porthole construction set forth in claim 2 wherein said openings are generally D-shaped and said projections have a generally complementary configuration.

4. The porthole construction set forth in claim 3 wherein said projections include a surface adapted to snap over a bead on said openings.

5. The porthole construction set forth in claim 1 wherein said first member has ends, said transverse wall of said first member extending from one of the axial wall of the first member.

6. The porthole construction set forth in claim 1 wherein said first member has ends, said transverse wall of said first member extending from the axial wall thereof intermediate its ends.

7. The porthole construction set forth in claim 1 including a third member substantially identical to said second member, said third member including an axial wall engaging the inner surface of the axial wall of the first member, said axial wall of said first member having a free end, said third member including a radial wall overlying the free end of said axial wall of said first member and a second axial wall extending toward the hull when the third member is in position on a hull.

8. The porthole construction set forth in claim 7 including fastening means extending from the radial wall of said third member toward said hull.

9. The porthole construction set forth in claim 7 wherein each said second and third member having raised projections defining openings, said interengaging means between said first member and second member comprising interfitting axial projections extending into said openings in said second member.

10. The porthole construction set forth in claim 9 wherein said openings are generally D-shaped and said projections have a generally complementary configuration.

11. The porthole construction set forth in claim 10 wherein said projections including a surface adapted to snap over a bead on said openings.

12. The porthole construction set forth in claim 9 wherein said raised projections on said third member engages an end of the axial wall on said first member.

* * * * *

UNITED STATES PATENT AND TRADEMARK OFFICE

CERTIFICATE OF CORRECTION

PATENT NO. : 4,669,410

DATED : June 2, 1987

INVENTOR(S) : George Howell

It is certified that error appears in the above–identified patent and that said Letters Patent are hereby corrected as shown below:

Column 2, line 54, "portable" should be --porthole--

Column 2, line 59, "portable" should be --porthole--

Signed and Sealed this

First Day of September, 1987

*Attest:*

DONALD J. QUIGG

*Attesting Officer*

*Commissioner of Patents and Trademarks*